US006502819B2

(12) United States Patent
Rieber et al.

(10) Patent No.: US 6,502,819 B2
(45) Date of Patent: Jan. 7, 2003

(54) CONVERTIBLE GAME TABLE

(75) Inventors: Frederick M. Rieber, Alum Bank, PA (US); Steven Hanson, North Kingstown, RI (US)

(73) Assignee: Hedstrom Corporation, Bedford, PA (US)

( * ) Notice: Subject to any disclaimer, the term of this patent is extended or adjusted under 35 U.S.C. 154(b) by 72 days.

(21) Appl. No.: 09/861,793

(22) Filed: May 21, 2001

(65) Prior Publication Data

US 2002/0098896 A1 Jul. 25, 2002

Related U.S. Application Data

(60) Provisional application No. 60/263,156, filed on Jan. 22, 2001.

(51) Int. Cl.[7] ..... A63F 3/00; A63F 9/00; A63D 13/00; A63D 15/00; A63D 15/04

(52) U.S. Cl. ..... 273/126 R; 273/352; 273/309; 273/108; 273/118 R; 473/10; 473/14; D21/317

(58) Field of Search ..... 273/317, 317.1, 273/108, 108.1, 108.5, 109, 309, 126 R, 127 R, 352, 118 A, 118 R, 123 R, 127 C; 473/1, 9, 10, 475, 115, 14, 116, 157–160, FOR 112, FOR 113; D21/317–323

(56) References Cited

U.S. PATENT DOCUMENTS

| | | | | | |
|---|---|---|---|---|---|
| 420,959 | A | * | 2/1890 | Rand | 473/116 |
| 462,843 | A | | 11/1891 | Kavanagh | |
| 512,337 | A | | 1/1894 | Standen | |
| 552,786 | A | | 1/1896 | Smith | |
| 1,221,803 | A | * | 4/1917 | Johnston | 273/352 |
| 1,531,880 | A | * | 3/1925 | Ritter | 273/352 |
| 1,979,177 | A | | 10/1934 | Staff | |
| 2,818,256 | A | | 12/1957 | Hooper | |
| 3,239,227 | A | * | 3/1966 | Roope | 273/127 R |
| 3,372,931 | A | * | 3/1968 | Oberg | 473/109 |
| 3,722,888 | A | * | 3/1973 | Ducharme | 273/126 R |
| 4,345,758 | A | * | 8/1982 | Kempf | 473/475 |
| 4,563,008 | A | * | 1/1986 | Fielden | 273/126 R |
| 5,029,863 | A | * | 7/1991 | Krawczyk | 273/113 |
| 5,031,919 | A | | 7/1991 | Dixon | |
| 5,069,460 | A | * | 12/1991 | Kulesza | 273/108.22 |
| 5,171,013 | A | | 12/1992 | Dooley | |
| 5,443,259 | A | * | 8/1995 | Segan et al. | 273/123 A |
| 5,630,760 | A | | 5/1997 | Brown et al. | |
| 6,349,939 | B1 | * | 2/2002 | Tsai | 273/309 |
| 6,419,224 | B1 | * | 7/2002 | Tsai | 473/10 |

OTHER PUBLICATIONS

Hedstrom Catalog, 1999.

* cited by examiner

*Primary Examiner*—Raleigh W. Chiu
*Assistant Examiner*—Mitra Aryanpour
(74) *Attorney, Agent, or Firm*—Cesari and McKenna, LLP

(57) ABSTRACT

A convertible game table which can be used to play a SKEE-BALL type game, a re-bound hockey or shuffle board game and pool or billiards utilizing different-size playing areas spaced at different elevations above the floor.

16 Claims, 4 Drawing Sheets

CONVERTIBLE GAME TABLE

RELATED APPLICATION

This application claims the benefit of Provisional Application No. 60/263,156 filed Jan. 22, 2001

BACKGROUND OF THE INVENTION

This invention relates to children's games. It relates more particularly to a convertible game table which may be used to play a version of the bowling game marketed under the brand name SKEE-BALL, as well as other games such as rebound hockey, pool and billiards.

Convertible game tables per se have been on the market for many years. Usually the games that can be played with such tables are fairly similar in that they are played within the same play area and at the same elevation above the floor. For example, U.S. Pat. No. 5,630,760 discloses a game table which can accommodate Foosball, basketball and glide hockey, all which are played within the same table area. U.S. Pat. No. 1,979,177 depicts convertible game apparatus for playing billiards, croquet, roque and clock golf. Again, all of these games are similar and are played within the same field or game surface and at the same elevation above the floor. Other game tables for playing different game combinations are known in the art, see e.g., U.S. Pat. Nos. 462,843; 512,337 and 552,786. Since the games that can be played on these prior tables are so similar, they may not hold the players' interests over the long term.

Also, some prior convertible game tables typified by the ones disclosed in the above patents are relatively complex and difficult to make and to assemble.

Therefore, it would be desirable if there existed a compact convertible game table which can be used to play several completely different games on a variable playing surface which may be positioned at different elevations above the floor depending upon the particular game being played.

SUMMARY OF THE INVENTION

Accordingly, it is the object of the present invention to provide an improved convertible game table.

Another object in the invention is to provide such a table which can be used to play several different games on different-area playing surfaces at different elevations above the floor.

A further object of the invention is to provide a convertible game table such as this, all of whose parts can be stored compactly in a single base unit which may function as a carrying case.

Another object of the invention is to provide a table of this type which provides audio and visual indications of game scores.

A further object of the invention is to provide a convertible game table which can be manufactured in quantity at relatively low cost.

Yet another object of the invention is to provide such a table which can be assembled quite easily by the consumer without requiring any special tools.

Other objects will, in part, be obvious, and, will in part, appear hereinafter. The invention accordingly comprises the features of construction, combination of elements and arrangement of parts which will be exemplified in the following detailed description and the scope of the invention will be indicated in the claims.

Briefly, the present convertible game table can be used to play a SKEE-BALL-type game, a rebound hockey or shuffle board game and pool or billiards, which utilize different playing areas and may be played at different elevations above the floor. In a SKEE-BALL-type game, a player rolls balls along a relatively flat runway or alley towards an upwardly curving ramp which, if the balls are rolled with sufficient momentum, will cause the balls to become airborne and land in an upwardly angled target area situated beyond the ramp. The target area contains different size receptacles, the receptacles receiving the balls determining the score. A portable SKEE-BALL-type table is known, for example, from U.S. Pat. No. 5,031,919.

However, to applicant's knowledge, such a game is not incorporated into a game is table capable of being used to play other completely different games such as pool and billiards. This is because a SKEE-BALL-type game requires a much longer playing surface than pool and is usually played closer to the floor than pool because the player has to roll the ball along the runway underhand as in bowling. As will be seen, the present table is able to be used for both of those games, as well as for a version of hockey or shuffle board in which a player slides a puck along a runway or alley to a rebound surface which causes the puck to rebound towards its point of origin to one of several target areas, the score being determined by the area in which the puck comes to rest. That game may be played at different elevations above the floor depending upon the heights and desires of the players.

As will be seen, when this game table is not being used, all of its components can be contained within a base which may function as a case to facilitate shipping and storing the table. The game table is composed of a minimum member of parts to accomplish its objectives, all of which parts can be made in quantity relatively inexpensively. Therefore, the game table should prove to be a highly marketable play item.

BRIEF DESCRIPTION OF THE DRAWINGS

For fuller understanding of the nature and objects of the invention, reference should be made to the following detailed description taken in connection with the accompanying drawings, in which.

DESCRIPTION OF THE PREFERRED EMBODIMENT

Figure 1:
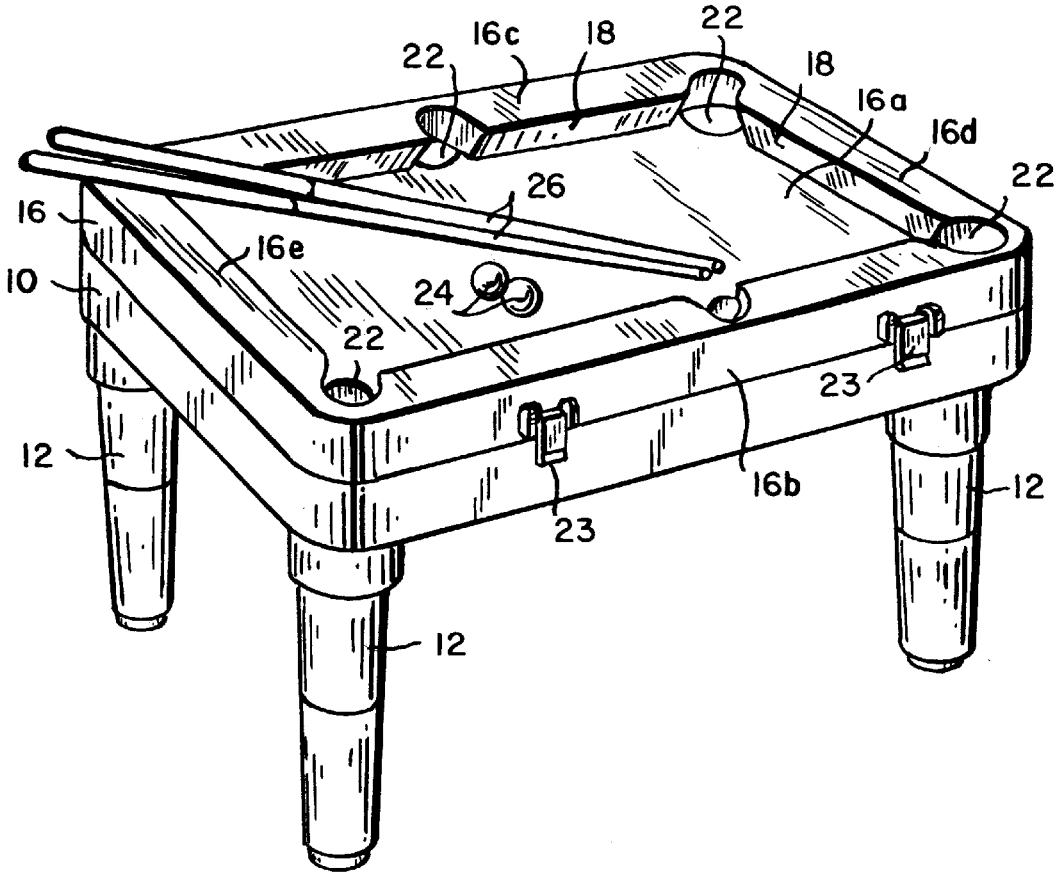
FIG. 1 is a perspective view of a convertible game table according to the invention, the table being shown in its pool or billiards play mode.

Referring to FIG. 1 of the drawings, the table comprises a generally rectangular base 10 having legs 12 extending down from the four comers of the base to the floor. Positioned on base 10 is a cover 16 having a bottom wall 16*a*, a pair of opposite side walls 16*b* and 16*c* and a pair of opposite end walls 16*d* and 16*e*. The interior surfaces of these walls define rails 18 which are interrupted at the corners and sides of the cover to provide entrances to pockets 22 in the bottom wall of cover 16. Preferably, latches 23 are present at opposite sides of cover 16 by which the cover may be releasably secured to base 10. Preferably also, rails 18 are resilient and the rails and bottom wall 16*a* have a felt overlay to provide suitable rebound and rolling surfaces for a set of pool balls 24. As is well known, players play pool by hitting balls 24 into pockets 22 using a set of pool cues 26. Alternatively, the balls and cues may be used to play the game of billiards on the table.

Figure 2:
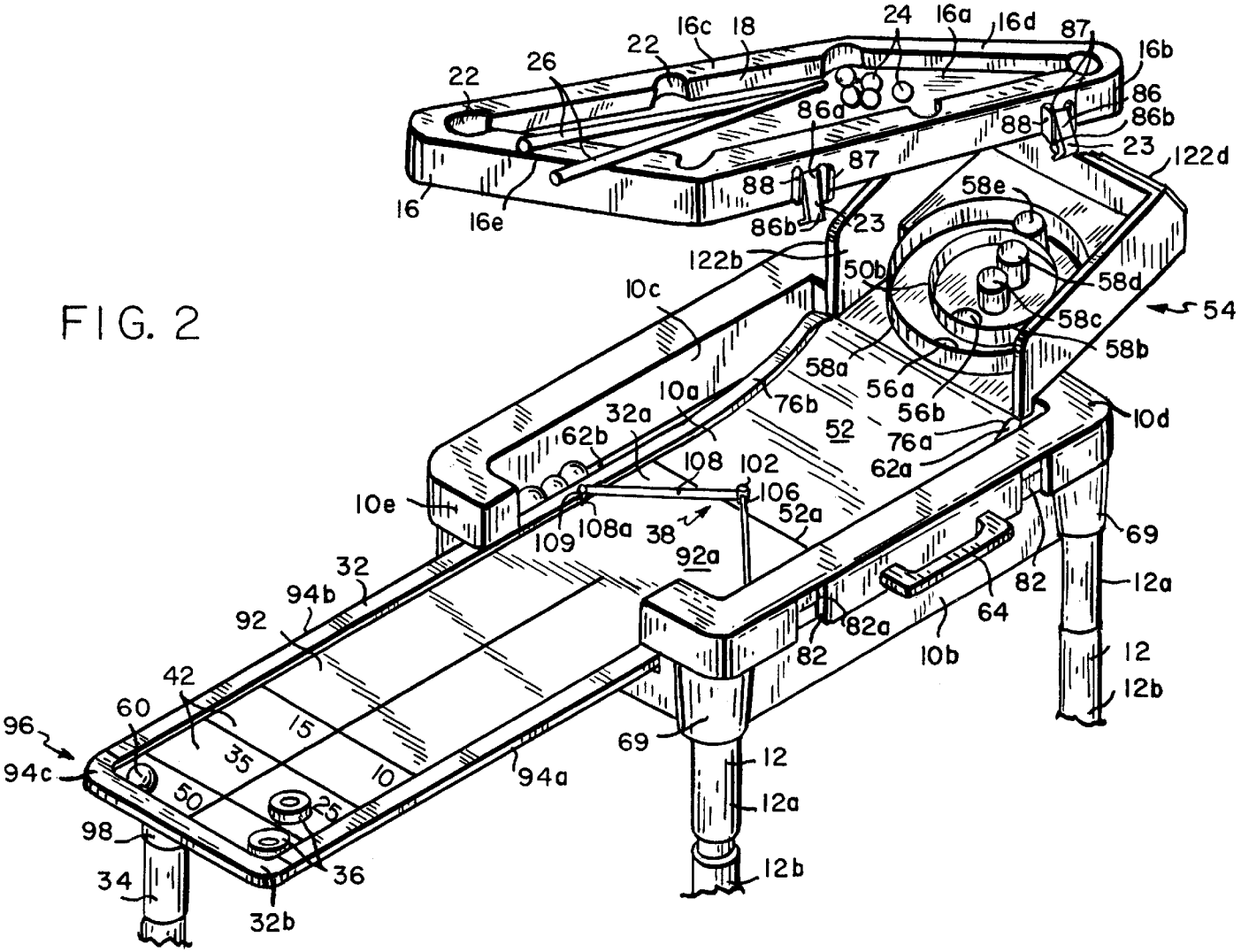
FIG. 2 is an exploded perspective view on a larger scale showing the components of the table that enable its use for playing rebound hockey or shuffle board and a SKEE-BALL-type game.

Referring now to FIG. 2, by releasing latches 23 and removing cover 16 from base 10, the table may be used to play a form of hockey or shuffleboard. For this, a relatively long, generally rectangular table extension 32 is assembled to the base. When so assembled, an end 32*a* of extension 32 is supported by the base, while the opposite end 32*b* of the extension is supported by a removable leg 34. Extension 32 defines a long runway or alley which functions as a sliding surface for a set of pucks 36 which a player, standing adjacent to end 32*b,* may push toward a rebound surface shown generally at 38 located near the extension end 32*a*. When the rebound surface 38 is impacted by a puck 36, it propels the puck back toward the extension end 32*b* where the puck comes to rest on one or another of several scoring areas 42 inscribed on extension 32 adjacent to its end 32*b*.

When playing rebound hockey or shuffleboard as aforesaid, it may be desirable to position the table closer to the floor particularly when the players are small in stature. Accordingly, the table legs 12 preferably consist of separable upper and lower equal-length sections 12*a* and 12*b* which sections can be connected together end to end by press fitting one within the other or by a threaded connection or other suitable means. By removing leg sections 12*b,* and using one of those as leg 34, the table will be positioned closer to the floor so that a shorter player can more easily slide the pucks 36 along the table extension 32.

Still referring to FIG. 2, with cover 16 removed, the table can also be used to play a SKEE-BALL-type game. To provide this game mode, base 10 is formed with an integral ramp 52 which is essentially a continuation of the installed extension 32. Ramp 52 ramps up to an upwardly angled target section shown generally at 54 which is mounted to the wall 10*d* end of base 10 beyond ramp 52. Target section 54 contains a plurality of target holes 56*a* to 56*e* surrounded by walls 58*a* to 58*e*. When a ball 60 is rolled along extension 32 to ramp 52 by a player, it is launched into the air by the ramp. Depending upon the skill of the player, that ball 60 lands in one or another of the holes 56*a* to 56*e* and the player receives a score depending upon which hole receives the ball. As will be described in detail later, the balls are conducted to ball return channels or gutters 62*a,* 62*b* formed integrally in base 10 on opposite sides of ramp 52. The gutters return the balls 60 to locations adjacent to extension end 32*b* where they can be picked up by the players.

When the game table is not in use, legs 12 and 34 may be separated from base 10 and extension 32, respectively, and the extension separated from base 10. Then, the target section 54 can be disengaged from base 10 and stored within the base adjacent to ramp 52. After placing all of the balls 24, 60, cues 26 and pucks 36 in the return gutters 62*a* and 62*b,* the extension 32 can be positioned on the base and the cover 16 latched to the top of the base using latches 23 to protectively enclose the various components of the game. Thus, the base 10 and cover 16 function as a rigid case for shipping, storing and handling the game table. To facilitate carrying the case, a handle 64 may be provided at one side of base 10 as shown in FIG. 2.

The Base 10

Figure 3:
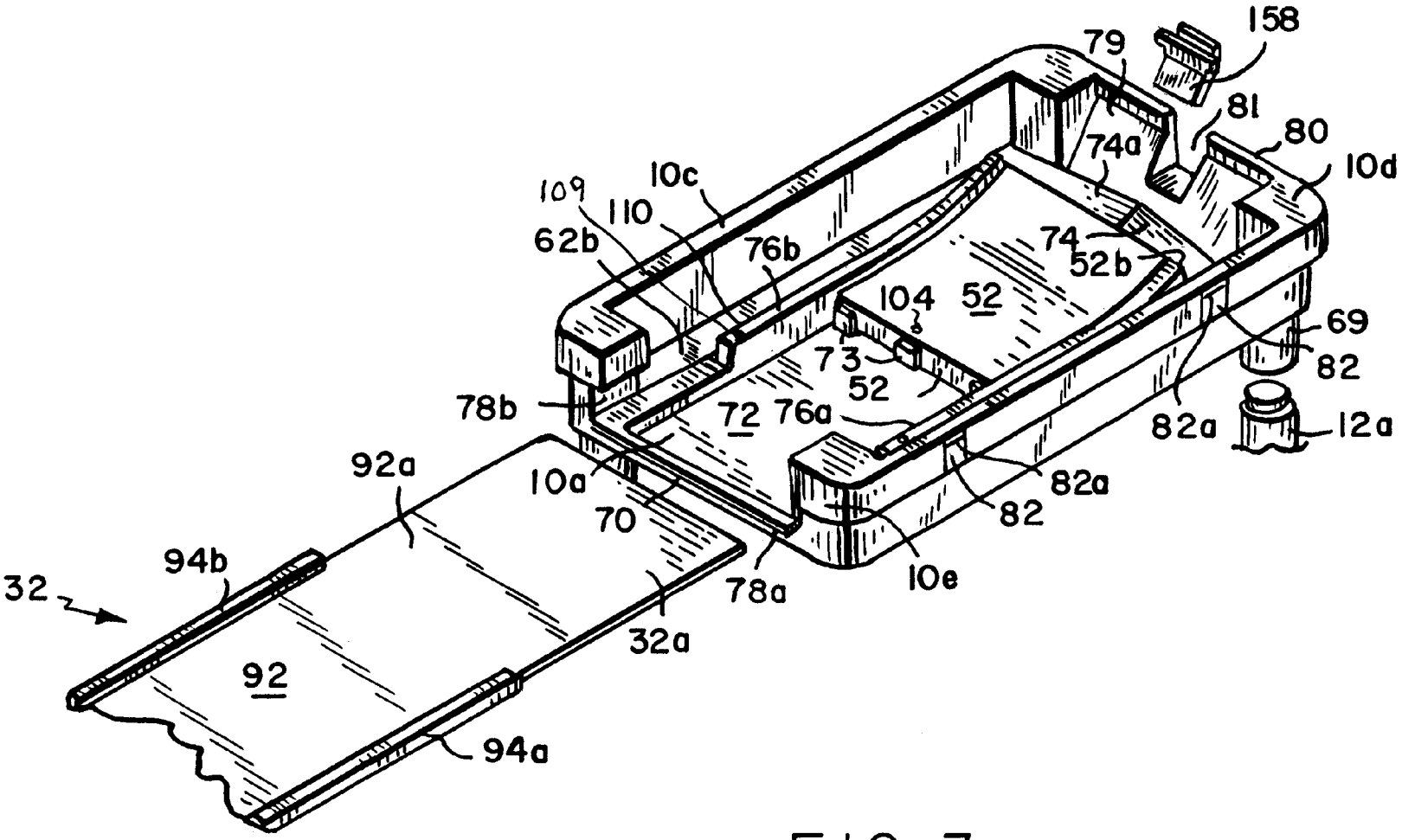
FIG. 3 is an exploded perspective view of the base component of the FIG. 1 table and the separate extension component thereof.
Figure 4:
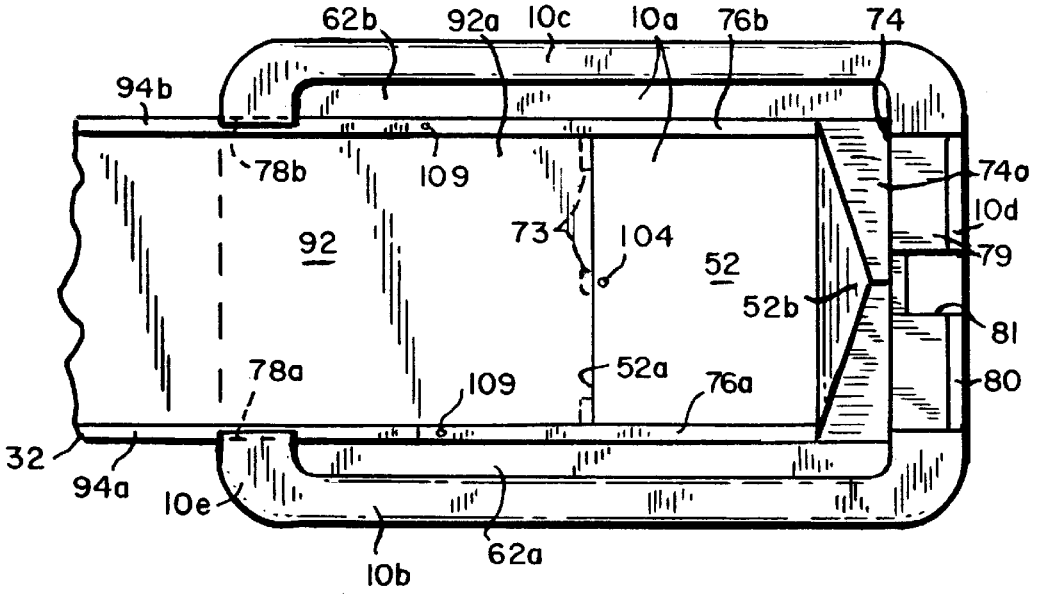
FIG. 4 is a top plan view showing the assembly of the extension component of the table to the base component thereof.

As shown in FIGS. 3 and 4, base 10 is a generally rectangular pan molded of a suitable strong rugged material such as polypropylene. The base includes a bottom wall 10*a* constituted by ramp 52 and gutters 62*a* and 62*b* the pair of relatively thick side walls 10*b* and 10*c* and shorter end walls 10*d* and 10*e*. Sockets 69 are located at the corners of is base 10 to slidably receive legs 12. End wall 10*e* is split to provide clearance for extension 32, a transverse reinforcing rail 70 extending between the two segments of end wall 10*e* to provide reinforcement. Note that ramp 52 extends only about halfway along base 10 so that a hole 72 exists between the lower end 52*a* of the ramp and rail 70. Preferably, bosses 73 (FIG. 3) are formed at the lower end 52*a* of the ramp to provide locating or support surfaces for extension end 32*a* when the extension 32 is assembled to the base as shown in FIGS. 2 and 4.

The ramp 52 ramps or curves up to a downwardly rearwardly extending surface 52*b* which, with the base end wall 10*d,* defines a transverse channel or pathway 74 whose opposite ends lead to the adjacent ends of the ball return channels or gutters 62*a* and 62*b*. The bottom wall 74*a* of channel 74 is crowned so that if a ball is dropped into channel 74, it is guided laterally by surface 52*b* and the channel bottom wall 74*a* into gutter 62*a* or 62*b*. The gutters are sloped downward toward the forward end wall 10*e* of base 10 so that any ball deposited in the gutters rolls toward the base end wall 10*e* adjacent to extension 32.

Referring to FIGS. 2 to 4, a pair of side rails 76*a* and 76*b* are formed at opposite sides of ramp 52 inboard gutters 62*a,* 62*b*. The side rails extend from the upper end of the ramp beyond the lower end 52*a* thereof to locations midway along the hole 72 (FIG. 3) in the bottom of base 10 such that the rails overhang the opposite side edges of the hole to some extent. In this, they define keyways 78*a* and 78*b* at opposite sides of hole 72 for receiving the rear end segment of extension 32 when assembling the extension to base 10 as will be described later. These keyways extend through the end wall 10*e* of the base at opposite ends of the gap therein above rail 70.

As best seen in FIG. 3, preferably the rear end wall 10*d* of base 10 has a sloped inside surface 79 which extends upwardly-rearwardly from channel bottom wall 74*a* almost to the top of the base leaving a thin vertical lip 80 extending along the top of wall 10*d*. Also, a vertical notch 81 is provided in the middle of the wall 10*d*, the notch extending down from the top of that wall almost to the channel bottom wall 74*a* . As will be described presently, this rear wall 10*b* construction is designed to support the target section 54 when the table is being used to play SKEE-BALL-type game.

As best seen in FIGS. 2 and 3, a pair of notches 82 is molded into the outside surface of side wall 10*b* of base 10 adjacent to the opposite ends of that wall. Similar notches (not shown) are also present in side wall 10*c*. Each notch has an upper wall or edge 82*a* which defines a ledge which may be engaged by a latch 23 when securing cover 16 to base 10.

The Cover 16

As shown in FIGS. 1 and 2, cover 16 comprises a generally rectangular part having generally the same length and width dimensions as base 10. The cover bottom wall 16*a* is of medium density fiberboard and the side and end walls 16*b* to 16*e* constitute a single molded plastic frame-like part, the bottom wall being secured to the bottom of that part. As noted above, the cover defines the top of a pool or billiard table with the inside surfaces of the side and end walls constituting the rails 18. The pockets 22 are formed at the inside comers of the cover as well as midway along the side walls 16*b,* 16*c* thereof. The rails 18 are covered with resilient foam strips and those strips and bottom wall 16*a* are covered with felt or other similar sheet material.

As noted above, cover 16 may be secured to the top of base 10 by means of latches 23. When base 16 is seated on base 10, there is a latch 23 located directly above each notch 82 in the base. As best seen in FIG. 2, each latch 23 comprises an arm 86 which is pivotally connected to cover 16 by a pin 88 which extends through one end 86*a* of the arm and through a pair of spaced-apart vertical ribs or walls 87 formed in a side wall of cover 16 which ribs or walls bracket the arm. The opposite end of each arm 86 has a nose or hook 86*b* which is arranged and adapted to engage under the upper wall 82*a* of the corresponding notch 82 in base 10.

The Extension 32

Referring now to FIGS. 2 to 4, extension 32 comprises a long rectangular sheet 92 of a stiff material such as medium density fiberboard. Mounted to opposite sides of sheet 92 is a pair of side rails 94*a* and 94*b*. These side rails extend from locations spaced somewhat from the forward end of sheet 92 approximately three fourths of the way along the sheet. This leaves a rear end segment 92*a* of sheet 92 which is devoid of rails and, as shown in FIG. 4, the length of this segment is more or less equal to the distance between the lower end 52*a* of ramp 52 in base 10 and the forward ends of the side rails 76*a,* 76*b* in the base. Furthermore, the width of the sheet segment 92*a* is such that it can be received in the keyways 78*a,* 78*b* formed in the base below those rails. Thus to assemble the extension 32 to base 10, the sheet segment 92*a* is slid along keyways 78*a*, 78*b* until the rear end segment 92*a* of sheet 92 seats on bosses 73 at the lower end 52*a* of ramp 52. It should be noted that the segments of the keyways which extend through the base end wall 10*e* are high enough to accept the forward end segments of the extension side rails 94*a* and 94*b*. Thus, when the extension is properly assembled to the base, the side rails 94*a,* 94*b* of the extension constitute extensions of the side rails 76*a* 76*b* of the base.

As shown in FIG. 2, the leading or forward end of sheet 92 is supported by an end section shown generally at 96 secured to that end of the sheet. Preferably, section 96 is a molded plastic part which forms a transverse end rail 94*c* which connects the leading ends of side rails 94*a,* 94*b,* as well as a downwardly extending socket 98 for receiving the upper end of leg 34. The leg 34 is usually the same length as the leg sections 12*b* supporting base 10 because the games played using extension 32 are usually played with base 10 relatively close to the floor, i.e. without leg sections 12*b*. As noted above, leg 34 may be one of the leg sections 12*b*. However, if a higher elevation of the table including extension 32 is desired, e.g. for taller children, leg 34 may be provided with an extension (not shown) similar to a leg section 12*a*.

As described above, extension 32 is assembled to base 10 in order to play either rebound hockey or a SKEE-BALL-type game. To play the former game, after the extension is assembled to the base as aforesaid, the rebound surface 38 is positioned on the rear end segment of the extension, i.e. on sheet segment 92*a*. As shown in FIGS. 2 and 3, rebound surface 38 may comprise a pin 102 which plugs into a hole 104 (FIG. 4) at the foot of ramp 52 midway between the side edges thereof Pin 102 is formed with a slot 106 for receiving a long, relatively heavy elastic band 108 whose opposite ends have enlargements or keys 108*a* so that they can be retained in slots or key holes 109 formed adjacent to the forward ends of the ramp side rails 76*a* and 76*b*. The segments of the elastic band 108 on opposite sides of pin 102 form angled rebound surfaces which when impacted by a puck 36 will cause the puck to rebound toward one of the extension side rails 94*a,* 94*b*. Whereupon, the puck will bounce off that rail and come to rest in one or another of the scoring areas 42 at the forward end of the extension 32.

The Target Section 54

Figure 5:
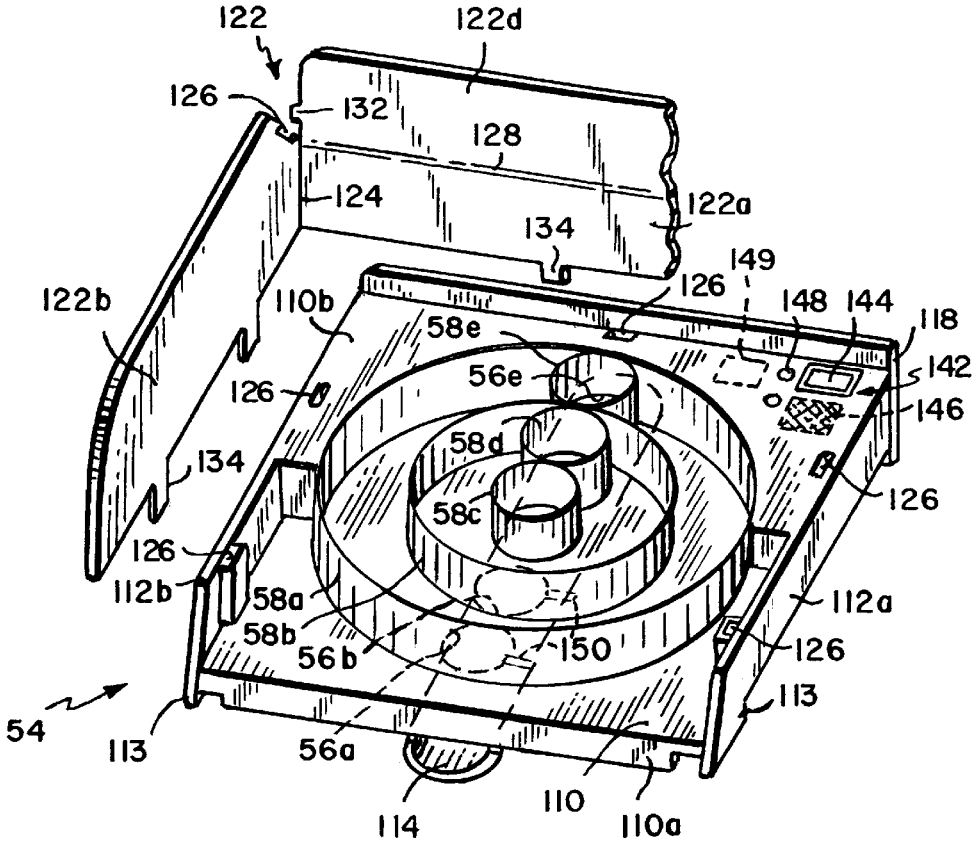
FIG. 5 is an exploded perspective view of the target section component of the table.

As shown in FIGS. 2 and 5, target section 54 is a molded plastic part which has the same width dimension as the sloped inside surface 79 of base end wall 10*b* so that the target section can be assembled to base 10 at that location as shown in FIG. 2. The target section includes a bottom wall or floor 110 having a downwardly-forwardly angled forward edge margin or flange 110*a*. A pair of side walls 112*a* and 112*b* extend up from the opposite side edges of floor 110 and preferably depending tabs 113 are present at the forward ends of those side walls for reasons that will be described later.

The target holes 56*a* to 56*e* described above are formed in floor 110 and the walls 58*a* to 58*e* surrounding those holes extend up from floor 110. While the walls 58*b* to 58*e* constitute rings, the outer wall 58*a* is partially formed by a rear section 110*b* of floor 110 which is raised to the tops of side walls 112*a* 112*b* This is to accommodate scoring electronics (not shown) incorporated into target section 54 underneath section 110*a*. Any time a ball 60 (FIG. 2) falls within one of the walls 58*a* to 58*e,* it is conducted by that wall to a corresponding hole 56*a* to 56*e*. A trough 114 is mounted to the underside of floor 110 to collect the balls that drop through the holes 56*a* to 56*e* and conduct them to the transverse channel 74 in base 10 (FIG. 3) so that the balls are returned to a player via gutters 62*a,* 62*b*.

As shown in FIG. 5, target section 54 is provided with a finished rear end wall 118 which extends above and below floor section 110*a*. When target section 54 is stored backwards in base 10 at hole 72 therein, the wall 118 is arranged and adapted to close the gap in the forward end wall 10*e* of the base.

In order to contain the balls which are rolled up ramp 52 to the target section 54, the target section is provided with a removable fence 122. Fence 122 is stamped from a single sheet of a clear plastic material such as high-density polyethylene. The fence has a rear section 122*a* and a pair of mirror-image side sections 122*b* connected by living hinges 124 to the opposite ends of section 122*a*. A portion of each side section 122*b* extends above hinges 124 and that portion has an angled edge adjacent to its hinge formed with slot 126. Also, section 122*a* has a vertical extension 122*d* connected to the upper edge of section 122*a* by a living hinge 128. In addition, tabs 132 are provided at the opposite ends of extension 122*d* directly opposite the adjacent slots 126. In order to install fence 122, side sections 122*b* are folded at the hinges 124 so that they extend perpendicular to section 122*a*. Then, extension 122*d* is folded forwardly about its hinge 128 so that the tabs 132 thereon can be inserted into the slots 126 in fence side sections 122*b*. As shown in FIG. 5, the lower edges of fence sections 122*a* and 122*b* are provided with depending tabs 134 which are adapted to plug into slots 126 formed in the target section side walls 112*a,* 112*b* and the floor section 110*a*. When the target section is not being used, the fence can be separated from floor 110 and unfolded so that it can be stored in a flat-condition.

In order to add enjoyment to the SKEE-BALL-type game, the target section 54 is provided with a scoring unit shown generally 142 in FIG. 5. The scoring unit includes a display 144 and voice or sound box 146 exposed at the surface floor section 110*a*. Also, unit 142 includes one or more control buttons 148 in section 110*a* to enable players to control the scoring unit. As noted above, the electronics for scoring unit 142 are located under floor section 110*a* and include the usual processor 149 to enable the scoring unit to show scores on display 144 and to signal via the voice or sound box when a ball 60 (FIG.2) falls into one of the holes 56*a* to 56*e*, the particular sound emitted by the voice box 146 depending upon the receiving hole which has an assigned score. For this, sensors or proximity switches 150 are located adjacent to each hole to sense each ball that falls through that hole and cause processor 149 initiate the sound and update the display 144.

Target section 54 is assembled to base 10 by positioning the forward end portion of the target section on the end wall 10*d* of the base. As noted above, that end wall has a notch 80 which provides clearance for gutter 114. When the target section is properly seated on base 10, the forward edge margin of the target section fits down into the space between rearwardly angled wall 52*b* and surface 79 of base 10 such that the tabs 113 at the sides of the scoring unit seat against surface 79, flange 110*a* of floor 110 bears against the angled wall 52*b* and the lip 80 of rear wall 110*d* engages the underside of section 54. The center of gravity of target section 54 is such that at the angle of surface 79, the target section is held to the base solely by gravity.

When the target section 54 is not being used and is separated from base 10, the notch 181 in the base end wall 10*d* may be closed by an insert 158 shown in FIG. 3 which keys into the notch.

When consolidating the components of the game for shipment or storage, the fence 122 is separated from the rest of target section 54 unfolded and placed on runway 32. Then, the target section 54 is seated backwards in the base 10 at hole 72 forward of the ramp 52 so that its wall 118 closes the gap in the base end wall 10*e*. The pucks 36 and the balls 60 may be deposited in one of the gutters 62*a*, 62*b* in base 10. Legs 12 and 34 may then be removed from their respective sockets 69, 98 and laid into the gutters 62*a*, 62*b* of base 10 and the pool cues 26 placed on top of the legs. Next, the extension 32 may be positioned on the base so that the end rail 94*c* thereof faces the rear end wall 10*d* of base 10 such that the depending socket 98 of the runway extends down into the transverse channel 74 between the upper end of the ramp 52 and the end wall 10*d* of the base. The now forward end of the extension sheet 92 fits in the gap in the base end wall 10*e* and may rest on the upper edge of the wall 118 of the thus stored target section 54. Finally, the cover 16 may be placed on base 10 and latched thereto using latches 23. When this is in done, the base 10 and cover 16 form a rigid case that protectively encloses all of the other components of the table. Thus, the game can be shipped and stored in a minimum amount of space and carried about conveniently using handle 64 (FIG. 2).

It will thus be seen that the objects set forth above, among those made apparent from the preceding description, are efficiently attained. Also, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A game table comprising a generally rectangular, pan-like base having a bottom wall and opposite side walls and opposite first and second end walls extending up from the bottom wall, said bottom wall including a ramp section having opposite side edges, a foot spaced from the first end wall and a head adjacent to the second end wall and at least one ball return gutter extending between one of said side walls and an adjacent side edge of the ramp section, and means defining keyways in said first end wall opposite the foot of the ramp section;

a plurality of similar legs releasably connected to the corners of the base to support the base above a support surface;

an elongated planar extension member having opposite sides and opposite first and second ends and being dimensioned and adapted to fit within the confines of said base, and an additional leg having the same length as each of said similar legs removably connected to the extension member at the first end thereof to support the first end of the extension member above the support surface, the second end of the extension member being adapted to key into said keyways so that the extension member abuts the foot of the ramp section and forms an extension of the ramp section.

2. The game table defined in claim 1 wherein each of the plurality of legs comprises separable upper and lower segments, and said additional leg has the same length as one of said lower segments.

3. The game table defined in claim 1 wherein the ramp section includes side rails at the opposite side edges of the ramp section, and the extension member includes an end rail at the first end thereof and side rails at the opposite sides thereof which form extensions of the ramp section rails when the extension member is keyed to the base.

4. The game table defined in claim 3 and further including an elastic rebound member extending between the sides of the extension member adjacent to the second end thereof, and scoring indicia inscribed on the extension member adjacent to the first end thereof.

5. The game table defined in claim 4 and further including a plurality of pucks for sliding along the extension member.

6. The game table defined in claim 1 and further including an upwardly inclined target section removably positioned on the second wall of the base adjacent to the head of the ramp section, said target section being dimensioned and adapted to fit within the confines of the base and including a bottom wall having a front facing the ramp section, a pair of opposite sides and a rear;

a plurality of scoring holes in the bottom wall, and trough means under the bottom wall for connecting said scoring holes to said at least one gutter adjacent to the second end if the base so that when a ball is received by any one of the scoring holes, it is conducted to said at least one gutter and rolls towards the first end of the base.

7. The game table defined in claim 6 and further including a wall surrounding each of said holes so that when a ball lands within a said wall, it is conducted to the corresponding hole, and a fence extending around the sides and rear of the bottom wall.

8. The game table defined in claim 7 and further including switch means for detecting when a ball is received in each of said holes;

signaling means, and electronic control means responsive to said switch means for controlling the signaling means to signal a score depending upon which holes receive balls.

9. The game table defined in claim 8 and further including a plurality of balls for rolling along the extension member up the ramp section and into the scoring holes.

10. The game table defined in claim 7 and further including a generally rectangular cover member having substantially the same length and width dimensions as said base, said cover member including a bottom wall having four corners and opposite sides;

a pair of opposite side walls and a pair of opposite end walls extending up from the bottom wall, the counter-facing surfaces of the side and end walls defining rails;

a plurality of pockets interrupting the bottom wall and rails at the corners of the bottom wall and midway along the sides thereof, and means for releasably securing the cover member to the base so that the cover member covers the bottom, side and end walls of the base.

11. The game table defined in claim 10 and further including a plurality of pool balls, and at least one pool cue.

12. A game table comprising a generally rectangular, pan-like base having a bottom wall and opposite side walls and opposite first and second end walls extending up from the bottom wall, said bottom wall including a ramp section having opposite side edges, a foot spaced from the first end wall and a head adjacent to the second end wall and means defining keyways in said first end wall opposite the foot of the ramp section;

a plurality of similar legs releasably connected to the comers of the base to support the base above a support surface;

an elongated planar extension member having opposite sides and opposite first and second ends and being dimensioned and adapted to fit within the confines of the base;

an additional leg having the same length as each of said similar legs removably connected to the extension member at the first end thereof to support the first end of the extension member above the support surface, the second end of the extension member being adapted to key into said keyways so that the extension member abuts the foot of the ramp section and forms an extension of the ramp section;

an elastic rebound member extending between the sides of the extension member adjacent to the second end thereof, and scoring indicia inscribed on the extension member adjacent to the first end thereof.

13. The game table defined in claim 12 wherein the rebound member comprises an elastic band having opposite ends releasably attached to the bottom wall of the base at opposite sides of the base adjacent to the first end wall of the base;

means are provided for attaching the elastic band substantially at or near its midpoint to the table adjacent to the second end of the extension member so that segments of the elastic band on opposite sides of the fastening means define an acute angle;

the extension member includes an end rail at the first end thereof and a side rails at the opposite sides thereof, and scoring indicia is inscribed on the extension member adjacent to the first end thereof.

14. A game table comprising a generally rectangular, pan-like base having a bottom wall and opposite side walls and opposite first and second end walls extending up from the bottom wall, said bottom wall including a ramp section having opposite side edges, a foot spaced from the first end wall and a head adjacent to the second end wall, a pair of ball return gutters extending between the side walls of the base and the adjacent side edges of the ramp section and a transverse all-return channel extending between the head of the ramp and the second end wall of the base and connecting corresponding ends of the ball return gutters, said channel having a bottom wall which is higher in the middle of the channel then at the ends thereof;

a plurality of similar legs releasably connected to the corners of the base to support the base above the support surface;

an elongated planar extension member having opposite sides and opposite first and second ends and being dimensioned and adapted to fit within the confines of the base;

an additional leg having the same length of each of said similar legs removably connected to the extension member at the first end thereof to support the first end of the extension member above the support surface, the second end of the extension member being adapted to key into said base so that the extension member abuts the foot of the ramp section and forms an extension of the ramp section, and an upwardly inclined target section removably positioned on the second wall of the base adjacent to the head of the ramp section, said target section being dimensioned and adapted to fit within the confines of the base and including a bottom wall having a front facing the ramp section, a pair of opposite sides and a rear, a plurality of scoring holes in the bottom wall, and a trough mounted to the underside of the bottom leading from said scoring holes to said channel so that when a ball is received by any one of the scoring holes, it rolls along the channel to one or the other of said gutters.

15. The game table defined in claim 14 and further including a generally rectangular cover member having substantially the same length and width dimension as said base, and mean for releasably securing the cover member to the base so that when the extension member and the target section are placed within the confines of the base, and the cover is secured to the base, the cover member covers the extension member and target section as well as the bottom side and end walls of the base thereby forming a protective enclosure.

16. The game table defined in claim 15 wherein said cover member includes a bottom wall having four corners and opposite sides;

a pair of opposite side walls and a pair of opposite end walls extending up from the bottom wall, the counter-facing surfaces of the side and end walls defining rails, and a plurality of pockets intercepting the cover member bottom wall and rails at the corners of the bottom wall and midway along the sides thereof.

* * * * *